United States Patent [19]

Young et al.

[11] 3,990,809

[45] Nov. 9, 1976

[54] HIGH RATIO ACTUATION LINKAGE

[75] Inventors: John Herman Young, South Windsor; Charles Edward Salisbury, Glastonbury, both of Conn.

[73] Assignee: United Technologies Corporation, Hartford, Conn.

[22] Filed: July 24, 1975

[21] Appl. No.: 598,894

[52] U.S. Cl. ..... 415/160; 415/163; 74/96

[51] Int. Cl.[2] ..... F04D 29/46

[58] Field of Search ..... 415/147, 150, 151, 160, 415/163; 74/96

[56] References Cited

UNITED STATES PATENTS

| | | | |
|---|---|---|---|
| 2,064,313 | 12/1936 | Moody | 415/163 |
| 3,841,788 | 10/1974 | Sljusare et al. | 415/160 |
| 3,954,349 | 5/1976 | Abild | 415/160 |

FOREIGN PATENTS OR APPLICATIONS

| | | | |
|---|---|---|---|
| 1,277,868 | 10/1961 | France | 415/149 |
| 1,037,058 | 8/1958 | Germany | 415/160 |
| 1,013,033 | 8/1957 | Germany | 415/160 |

*Primary Examiner*—Henry F. Raduazo
*Attorney, Agent, or Firm*—Charles A. Warren

[57] ABSTRACT

In adjusting turbine vanes to control the nozzle area, the unison ring actuates a lever that has one end fixed to the vane casing ring and the vane actuating arm is connected to the lever at a point between the ends to reduce actuating forces required by the unison ring and to permit close tolerance control on the vane angle position.

3 Claims, 2 Drawing Figures

HIGH RATIO ACTUATION LINKAGE

The invention herein described was made in the course of or under a contract or subcontract thereunder, with the Department of the Navy.

BACKGROUND OF THE INVENTION

As gas turbine engines become more sophisticated, the need for precision control of the vane angle thereby to determine precisely the turbine vane nozzle area becomes more important. A direct connection from the unison ring to the vane arm requires high actuating forces on the ring with resultant problems in precise control. Such a connection also fails to provide the precise location of the vane necessary in matching the nozzle area to the compressor flow.

SUMMARY OF THE INVENTION

The purpose of the present invention is to make possible a precise control of the vane position thereby reducing the vane angle tolerance to a minimum. At the same time the present arrangement reduces the necessary actuating forces on the vane linkage, permitting easier movement of the unison ring with a greater movement of the ring required for each increment of vane angle change.

According to this invention, the vane arm by which the vane is turned is connected by a link to a lever which engages the unison ring at one end and is pivoted on the turbine casing at the other. The link engages the lever between its ends so that a pivotal movement of the lever, resulting from unison ring movement produces a movement of the link and a resulting turning movement of the vane arm and the vane connected thereto. The invention is equally applicable to variable compressor vanes.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
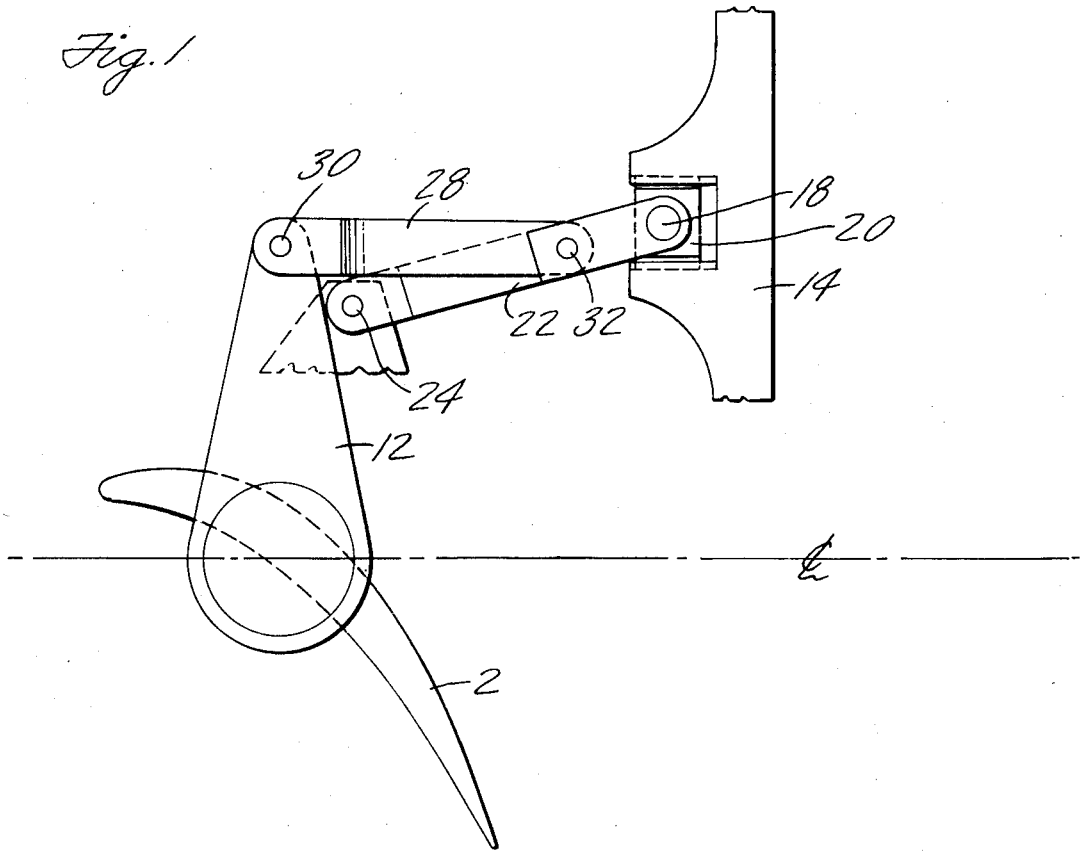
FIG. 1 is a plan view of the actuating mechanism.
Figure 2:
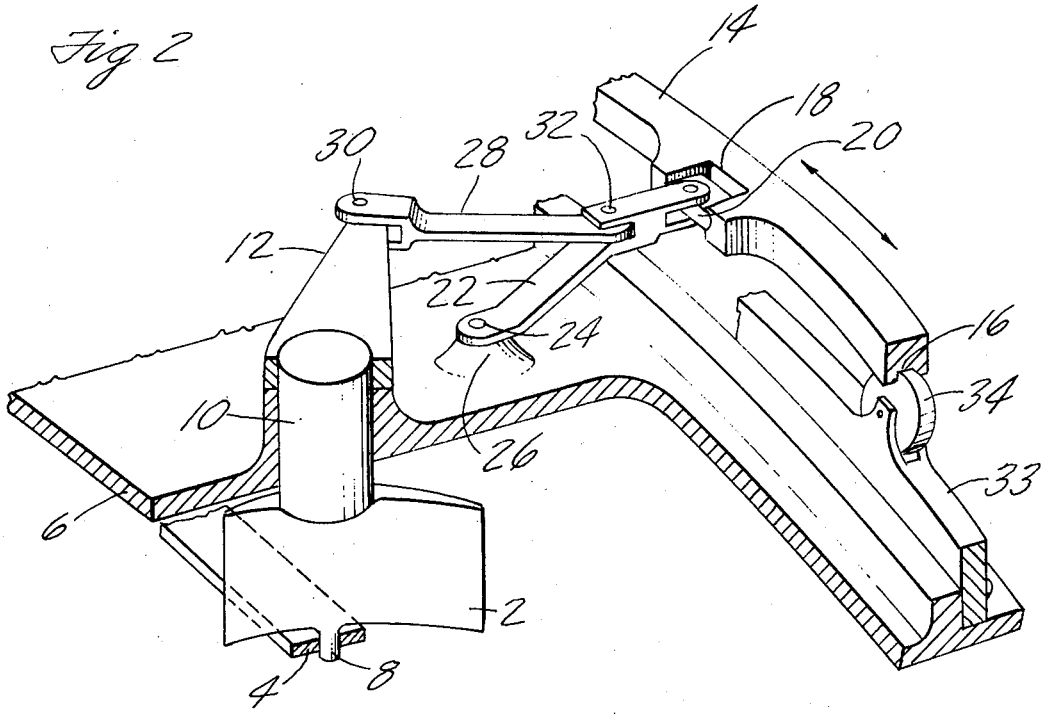
FIG. 2 is an isometric sectional view showing the vane actuated thereby.

As shown in the drawing the vane 2 is one of a row of turbine vanes positioned in a ring and pivoted in each of the inner casing ring 4 and the outer turbine casing 6. To this end the vane has a pin 8 on the inner end fitting in the ring 4 and a stub shaft or pin 10 on the outer end extending through the casing 6. The outer end of pin 10 has mounted thereon a vane actuating arm 12 by which the vane is turned on its axis in adjusting the nozzle area. This structure is well known in the present day gas turbine as shown for example in U.S. Pat. No. 2,651,496 to Buckland et al.

The several vanes 2 making up the row of vanes all carry similar actuating arms and they are all moved in unison from a unison ring 14 extending around the casing and circumferentially movable to adjust the position of the vane. This ring 14 is guided by several bearings 34 which engage the ring in slot 16. The bearings are mounted on a flange 33 forming a part of the outer turbine casing. This ring 14, as shown in FIG. 1, has notches 18 therein to receive a slider 20 pivoted to the movable end of a lever 22. The slider provides for axial movement of the end of the lever as the ring moves circumferentially.

The end of the lever 22 remote from the slider is mounted to turn on a fixed pin 24 carried by the casing 6, the pin being located adjacent to the free end of the vane actuating arm, as for example, in a boss 26 integral with the casing. A link 28 is pivoted at one end to the free end of the actuating arm 12 by a pin 30 and at the other end to the lever 22 between its ends as by a pin 32. With this arrangement it will be clear that movement of the slider 20 by the unison ring will pivot the lever 22 about the fixed pin 24 and thereby through link 28, move the vane actuating arm to move the vane. The precision of this actuating mechanism may be increased by the proximity of the pivot pin 24 to the end of the actuating arm and the location of the pivot pin 32 on the lever 22. An increase in the precision will necessitate a greater length of movement of the unison ring for a comparable vane movement thereby reducing the actuating force needed to move the unison ring. A location of the pivot pin 32 relatively close to the slider end of the lever is found to produce the desired relation between the extent of movement of the ring needed for the desired turning of the vane.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. An actuating mechanism for each turbine vane in a row of vanes including:

an outer casing, a row of vanes positioned in said casing and pivoted therein on substantially radial axes, each vane having a stub shaft thereon extending through the casing and on which the vane is pivoted, an arm on said shaft externally of the casing, a unison ring circumferentially slidable on the casing, and having axial slots therein, one for each vane, a lever pivoted at one end on the casing and having its other end engageable with and movable with the ring, a link from the end of the vane arm to the lever between the ends thereof for movement of the vane arm by movement of the lever, the link being pivoted to the arm and lever, and a slider on the ring end of each lever fitting in and movable in the associated slot in the ring.

2. An actuating mechanism as is claim 1 in which the link is connected to the lever at a point adjacent to the slider end of the lever.

3. An actuating mechanism as in claim 1 in which the lever support on the casing is closely adjacent to the free end of the vane arm.

* * * * *